US007195502B2

(12) United States Patent
Kwon

(10) Patent No.: US 7,195,502 B2
(45) Date of Patent: Mar. 27, 2007

(54) MULTI-FUNCTION CONNECTOR FOR VEHICLES

(75) Inventor: Mun-Soon Kwon, Yongin-si (KR)

(73) Assignee: Hyundai Autonet Co., Ltd., Gyeonggi-do (KR)

( * ) Notice: Subject to any disclaimer, the term of this patent is extended or adjusted under 35 U.S.C. 154(b) by 0 days.

(21) Appl. No.: 11/285,018

(22) Filed: Nov. 23, 2005

(65) Prior Publication Data

US 2007/0010128 A1 Jan. 11, 2007

(30) Foreign Application Priority Data

Jul. 5, 2005 (KR) ..... 10-2005-0060153

(51) Int. Cl.
*H01R 29/00* (2006.01)

(52) U.S. Cl. ..... 439/188

(58) Field of Classification Search ..... 439/188, 439/189, 241, 513; 324/506
See application file for complete search history.

(56) References Cited

U.S. PATENT DOCUMENTS 4,906,203 A * 3/1990 Margrave et al. ..... 439/188
5,505,631 A * 4/1996 Schauer et al. ..... 439/188

* cited by examiner

*Primary Examiner*—Alexander Gilman
(74) *Attorney, Agent, or Firm*—Peter F. Corless; Edwards Angell Palmer & Dodge LLP

(57) ABSTRACT

Disclosed herein is a multi-function connector for vehicles. The multi-function connector of the present invention includes a connector housing, and a plurality of terminals which are disposed in the connector housing and are connected at ends thereof to wires. The connector further includes a conductor which is coupled to at least two terminals and electrically connects the terminals to each other, and a nonconductor which surrounds the conductor. The conductor is a plate type conductor which has an elastic locking part formed by protruding and bending a part of the plate type conductor. A locking groove, having a shape corresponding to the elastic locking part, is formed in the nonconductor, so that coupling of the conductor to the nonconductor is maintained by insertion of the elastic locking part into the locking groove. Therefore, the multi-function connector of the present invention can serve as both a connector for wire connection and a connector for wire shorting, thus being used for multiple purposes. Furthermore, because the plate type conductor of the intermediate connection unit is assembled with the nonconductor by a fitting method, the structure and the manufacturing process of the connector are simplified, thus reducing the consumption of material.

2 Claims, 5 Drawing Sheets

MULTI-FUNCTION CONNECTOR FOR VEHICLES

CROSS-REFERENCE TO RELATED APPLICATIONS

The present application is based on, and claims priority from, Korean Application Serial Number 10-2005-0060153, filed on Jul. 5, 2005, the disclosure of which is hereby incorporated by reference herein in its entirety.

FIELD OF THE INVENTION

The present invention relates to connectors for vehicles and, more particularly, to a multi-function connector for vehicles which is used for electrically connecting various wires, provided in a vehicle, in an appropriate manner as required.

BACKGROUND OF THE INVENTION

Generally, vehicles include a variety of electrical field equipment. Such electrical field equipment is constructed such that power and signals are supplied to the electrical field equipment through a plurality of wires. Furthermore, a plurality of connectors is used for electrically connecting the wires to each other.

In other words, connectors provided on ends of wires are coupled to each other, so that two or more wires are electrically connected to each other without permanent connection, thus electrically connecting the variety of electrical field equipment to each other.

However, in a conventional technique, when it is desired to short some wires of a vehicle during a wiring process, a separate connector for wire shorting must be used. As such, if a separate connector for wire shorting is used, the length of wires is increased and, as well, the number of terminals is increased. Furthermore, there is a disadvantage in that tape must be unwound from a previously assembled wiring harness when a rewiring process is required.

In addition, to set circuits for speakers, side rear view mirrors, backup lamps, license lamps, trunk lid solenoids, etc., separate connection terminals for connection of wires are necessary. However, such connection terminals are not strongly resistant to vibration of the vehicle, thus deteriorating quality of the vehicle.

SUMMARY OF THE INVENTION

Embodiment of the present invention provides a multi-function connector for vehicles which includes an intermediate connection unit installed in a connector for a wire connection, so that the length of wire and the number of terminals are reduced, and, when rewiring, a process of unwinding a tape from a previously assembled wiring harness is not required, and which can serve as both a connector for wire connection and a connector for wire shorting, thus being used for multiple purposes.

Another embodiment of the present invention provides a multi-function connector for vehicles in which a plate type conductor of the intermediate connection unit is assembled with a nonconductor by a fitting method, so that the structure and the manufacturing process of the connector are simplified, thus reducing the consumption of materials.

A multi-function connector for vehicles includes a connector housing and a plurality of terminals disposed in the connector housing, each of the terminals being connected at an end thereof to a wire. A conductor has a plate shape and is coupled to at least two terminals so as to electrically connect the terminals to each other, with an elastic locking part formed in the conductor by protruding and bending a part of the conductor; a nonconductor surrounding the conductor, with a locking groove formed in the nonconductor and having a shape corresponding to the elastic locking part of the conductor, so that coupling of the conductor to the nonconductor is maintained by insertion of the elastic locking part into the locking groove.

The conductor having the plate shape may be slitted at a predetermined position, and opposite sides of the slitted portion of the conductor may be curvedly bent, so that, when a terminal is fitted into the slitted portion of the conductor, the fitted state is maintained by elasticity of the opposite sides of the slitted portion of the conductor.

The multi-function connector may further include a stop protrusion provided at a predetermined position on an outer surface of the nonconductor, and a stop groove formed at a predetermined position in the connector housing, so that the stop protrusion of the nonconductor is inserted into the stop groove of the connector housing.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENTS

Hereinafter, a preferred embodiment of the present invention will be described in detail with reference to the attached drawings.

Figure 1:
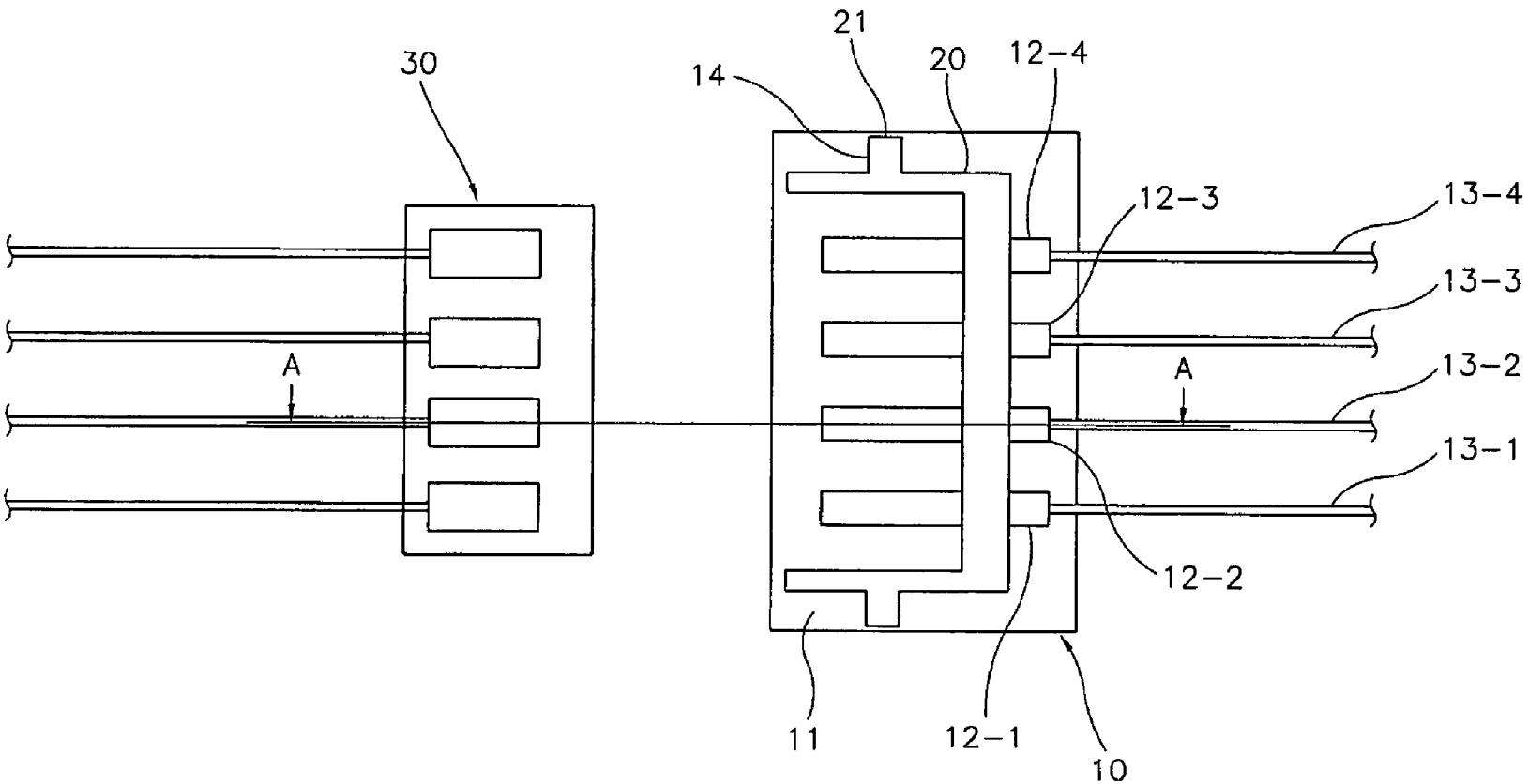
FIG. 1 is a view showing a multi-function connector for vehicles, according to the present invention.

FIG. 1 is a view showing the construction of a multi-function connector for vehicles, according to the present invention. As shown in FIG. 1, the present invention is constructed such that two connectors 10 and 30 are coupled to each other. A plurality of terminals 12-1, 12-2, 12-3 and 12-4 is disposed in a housing 11 of the connector 10. The terminals 12-1, 12-2, 12-3 and 12-4 are coupled to wires 13-1, 13-2, 13-3 and 13-4, respectively.

Furthermore, an intermediate connection unit 20 is provided in the housing 11 of the connector 10 so as to electrically connect at least two of the terminals 12-1, 12-2, 12-3 and 12-4 to each other. A stop protrusion 21 is provided on an outer surface of the intermediate connection unit 20. A stop groove 14 is formed in the housing 11 of the connector 10, so that the stop protrusion 21 of the intermediate connection unit 20 is inserted into the stop groove 14.

Figure 2:
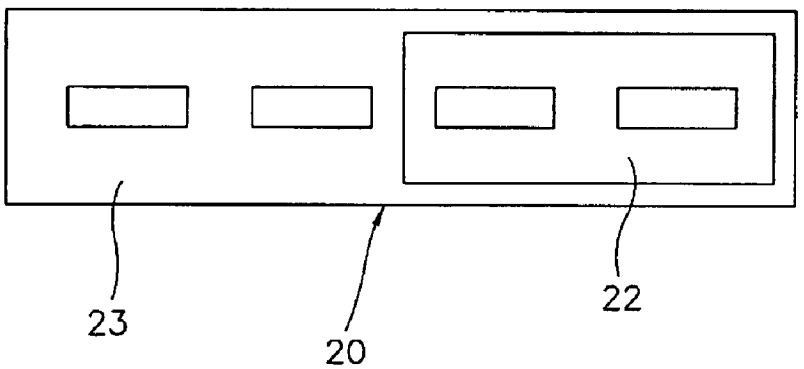
FIG. 2 is a view showing the construction of an intermediate connection unit of the multi-function connector of FIG. 1, showing a first embodiment of the present invention.

In a first embodiment of the present invention, as shown in FIG. 2, an intermediate connection unit 20 includes a conductor 22, which is coupled to two terminals of the four terminals 12-1, 12-2, 12-3 and 12-4 and electrically connects them to each other, and a nonconductor 23, which surrounds the conductor 22. A stop protrusion 21 is provided on the nonconductor 23 of the intermediate connection unit 20.

Figure 3:
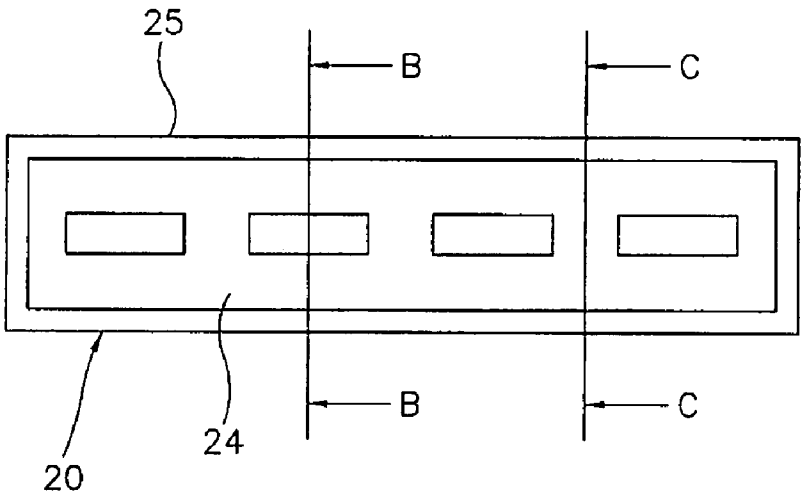
FIG. 3 is a view corresponding to FIG. 2, but showing a second embodiment of the present invention.

Meanwhile, in a second embodiment of the present invention, as shown in FIG. 3, an intermediate connection unit 20 includes a conductor 24, which is coupled to all four terminals 12-1, 12-2, 12-3 and 12-4 and electrically connects them together, and a nonconductor 25, which surrounds the conductor 24. A stop protrusion 21 is provided on the nonconductor 25 of the intermediate connection unit 20.

Figure 4:
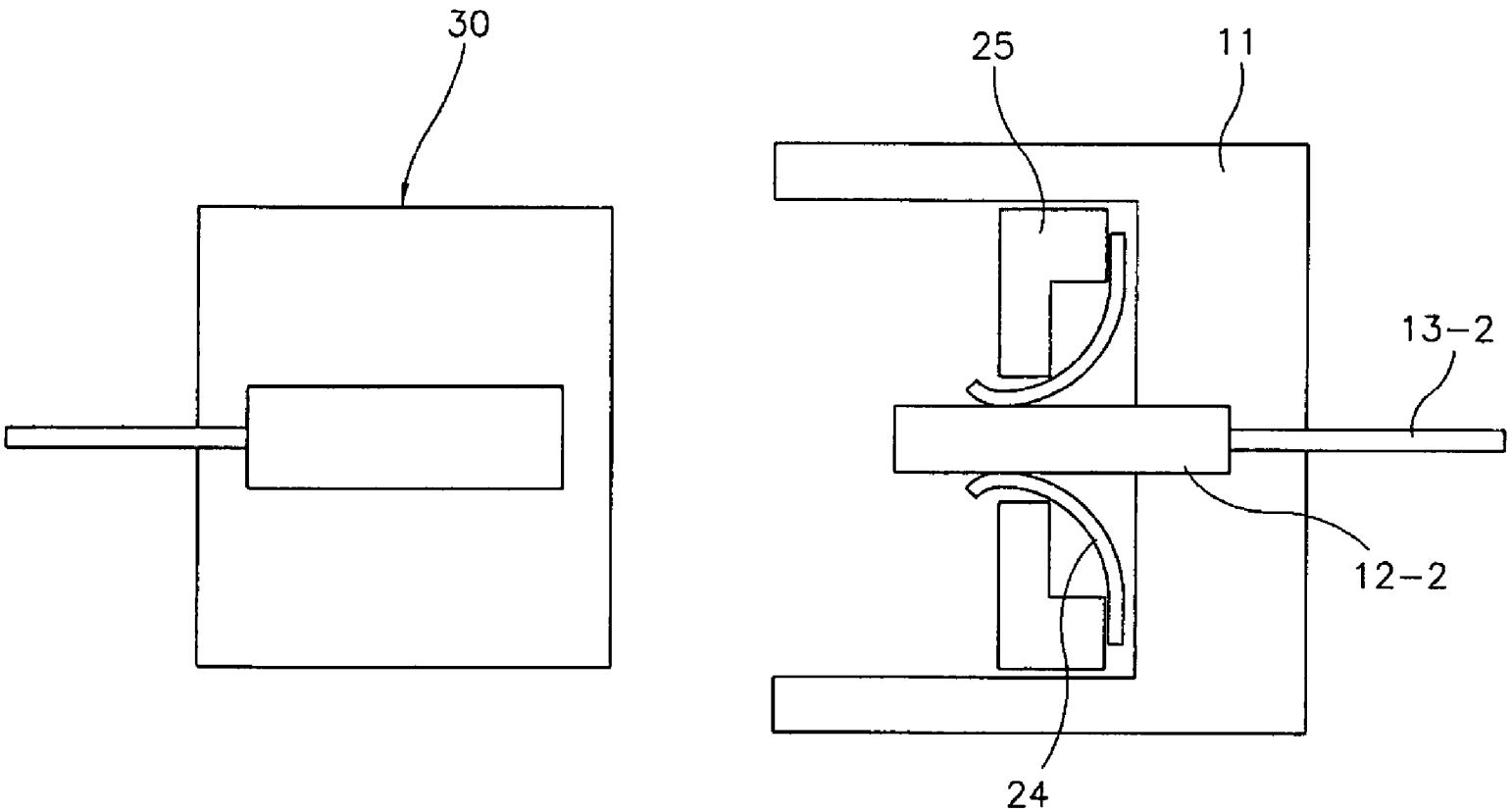
FIG. 4 is a sectional view taken along the line A—A of FIG. 1.
Figure 6:
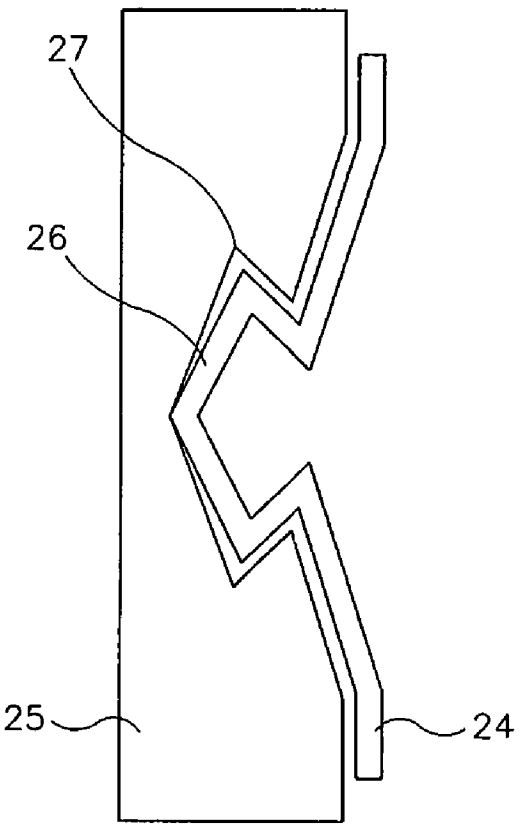
FIG. 6 is a sectional view taken along the line C—C of FIG. 3.
Figure 5:
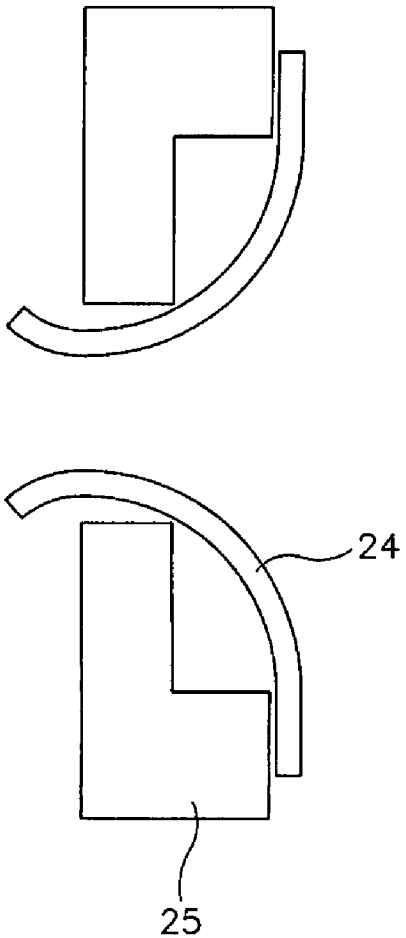
FIG. 5 is a sectional view taken along the line B—B of FIG. 3.

As shown in FIGS. 4 through 6, the conductor 24, surrounded by the nonconductor 25, is a plate type conductor. An elastic locking part 26 is formed at a predetermined position in the conductor 24 by protruding and bending a part of the conductor 24. A locking groove 27, which has a shape corresponding to the elastic locking part 26 of the conductor 24, is formed in the nonconductor 25. Thus, the conductor 24 is securely coupled to the nonconductor 24 by insertion of the elastic locking part 26 into the locking groove 27.

Furthermore, the plate type conductor 24 is slitted at a predetermined position, and opposite sides of the slitted portion of the conductor 24 are curvedly bent. Thus, when a terminal is fitted into the slitted portion of the conductor 24, the fitted state is securely maintained by the elasticity of the opposite sides of the slitted portion of the conductor 24.

The operation and effect of the multi-function connector of the present invention having the above-mentioned construction will be explained herein below.

The terminals 12-1, 12-2, 12-3 and 12-4, which are respectively connected to the wires 13-1, 13-2, 13-3 and 13-4, are installed in the housing 11 of the connector 10. Thereafter, as shown in FIG. 2 or 3, the intermediate connection unit 20 is coupled to some or all of the terminals 12-1, 12-2, 12-3 and 12-4. At this time, the stop protrusion 21, which is provided on the outer surface of the intermediate connection unit 20, is hooked to the stop groove 14 formed in the housing 11 of the connector 10.

When the connector 10, assembled through the above-mentioned process, is coupled to another connector 30, terminals of the connector 10, which are electrically connected to each other by the intermediate connection unit 20, and terminals of the other connector 30, which are connected to the associated terminals of the connector 10, are electrically shorted, thereby serving as a short connector.

Here, the conductor 24 of the intermediate connection unit 20, which is a plate type conductor and electrically connects some terminals 12-1, 12-2, 12-3 and 12-4 to each other, includes the elastic locking part 26, which is formed by protruding and bending a part of the conductor 24. As well, the locking groove 27 corresponding to the elastic locking part 26 of the conductor 24 is formed in the nonconductor 25. Therefore, the conductor 24 is securely coupled to the nonconductor 25 by insertion of the elastic locking part 26 into the locking groove 27. As such, the present invention has a simple structure, so that the manufacturing process is simplified, and consumption of materials is reduced.

Furthermore, the remaining terminals, which are not electrically connected to the intermediate connection unit 20, are normally coupled to respective wires, thus serving as connectors for wire connection.

Figure 7:
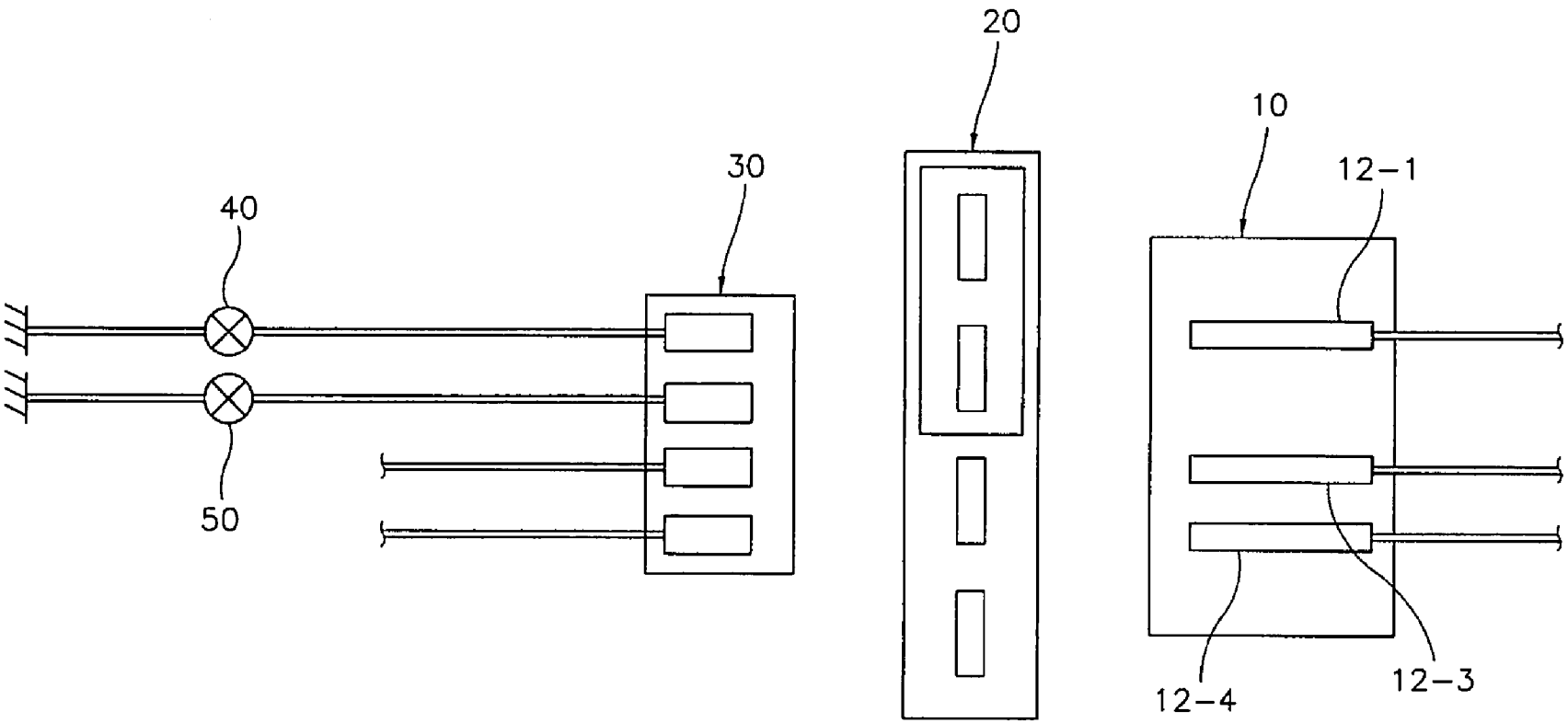
FIG. 7 is a view showing an example of use of the multi-function connector according to the present invention.

FIG. 7 is a view showing an example of use of the multi-function connector according to the present invention. As shown in FIG. 7, in the case of the connector 10 provided with the intermediate connection unit 20, when the connectors 10 and 30 are coupled to each other, both a wire, which is connected to a left brakelight 40, and a wire, which is connected to a right brakelight 50, are electrically connected to one power supply terminal 12-1. Accordingly, a separate connection terminal, which connects the wire of the left brakelight 40 to the wire of the right brakelight 50, is not required.

As is apparent from the foregoing, in the present invention, an intermediate connection unit is installed in a connector for wire connection, so that the length of wire and the number of terminals are reduced. As well, when rewiring, a process of unwinding a tape from a previously assembled wiring harness is not required. In addition, the connector of the present invention can serve as both a connector for wire connection and a connector for wire shorting, thus being used for multiple purposes.

Furthermore, because a plate type conductor of the intermediate connection unit is assembled with a nonconductor by a fitting method, the structure and the manufacturing process of the connector are simplified, thus reducing the consumption of materials.

What is claimed is:

1. A multi-function connector for vehicles, comprising:

a connector housing:

a plurality of terminals disposed in the connector housing, each of the terminals being connected at an end thereof to a wire;

a conductor having a plate shape and coupled to at least two terminals so as to electrically connect the terminals to each other, with an elastic locking part formed in the conductor by protruding and bending a part of the conductor;

a nonconductor surrounding the conductor, with a locking groove formed in the nonconductor and having a shape corresponding to the elastic locking part of the conductor, so that a coupling of the conductor to the nonconductor is maintained by insertion of the elastic locking part into the locking groove, wherein the conductor is slitted at a predetermined position, and opposite sides of the slitted portion of the conductor are curvedly bent, so that, when a terminal is fitted into the slitted portion of the conductor, the fitted state is maintained by elasticity of the opposite sides of the slitted portion of the conductor.

2. The multi-function connector as defined in claim 1, further comprising:

a stop protrusion provided at a predetermined position on an outer surface of the nonconductor; and a stop groove formed at a predetermined position in the connector housing, so that the stop protrusion of the nonconductor is inserted into the stop groove of the connector housing.

* * * * *